US010984719B2

(12) United States Patent
Xu et al.

(10) Patent No.: US 10,984,719 B2
(45) Date of Patent: Apr. 20, 2021

(54) PIXEL CIRCUIT UNIT, DRIVING METHOD THEREOF, DISPLAY PANEL AND DISPLAY DEVICE

(71) Applicant: BOE TECHNOLOGY GROUP CO., LTD., Beijing (CN)

(72) Inventors: Pan Xu, Beijing (CN); Cuili Gai, Beijing (CN); Yi Cheng Lin, Beijing (CN); Ling Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/607,286

(22) PCT Filed: Apr. 12, 2019

(86) PCT No.: PCT/CN2019/082416

§ 371 (c)(1),
(2) Date: Oct. 22, 2019

(87) PCT Pub. No.: WO2019/196925

PCT Pub. Date: Oct. 17, 2019

(65) Prior Publication Data

US 2020/0388220 A1 Dec. 10, 2020

(30) Foreign Application Priority Data

Apr. 12, 2018 (CN) ..... 201810326602.4

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01);
(Continued)

(58) Field of Classification Search
CPC ..... G09G 3/32–3291; G09G 2320/045; G09G 2320/046; G09G 2320/048; G09G 2300/0866; G09G 2300/0809
See application file for complete search history.

(56) References Cited

U.S. PATENT DOCUMENTS 9,147,723 B1 * 9/2015 Lee ..... G09G 3/3225
10,672,315 B2 * 6/2020 Chen ..... G09G 3/3233
(Continued)

FOREIGN PATENT DOCUMENTS

CN 203931451 U 11/2014
CN 106023893 A 10/2016
(Continued)

OTHER PUBLICATIONS

International Search Report of PCT/CN2019/082416 in Chinese, dated Jul. 10, 2019, with English translation.

*Primary Examiner* — Sanjiv D. Patel
(74) *Attorney, Agent, or Firm* — Collard & Roe, P.C.

(57) ABSTRACT

A pixel circuit unit, a driving method thereof, a display panel and a display device are disclosed. The pixel circuit unit includes a plurality of pixel drive circuits and a voltage control circuit including a first terminal and a second terminal; the first terminal is connected with a first voltage terminal to receive a first supply voltage provided by the first voltage terminal; each pixel drive circuit includes a light-emitting drive circuit including a supply voltage receiving terminal and a control terminal; the supply voltage receiving terminal is electrically connected with the second terminal, so as to allow the supply voltage receiving terminal to be capable of receiving the first supply voltage; and the voltage control circuit is configured to be disconnected in a data voltage writing stage, so that the supply voltage receiving terminal does not receive the first supply voltage in the data voltage writing stage.

19 Claims, 3 Drawing Sheets

(52) U.S. Cl.
CPC ..... *G09G 2300/0452* (2013.01); *G09G 2310/0278* (2013.01)

(56) References Cited

U.S. PATENT DOCUMENTS

| | | | | |
|---|---|---|---|---|
| 2011/0279437 | A1* | 11/2011 | Komiya | G09G 3/3233 345/212 |
| 2016/0216800 | A1* | 7/2016 | Cho | G09G 3/3233 |
| 2017/0004776 | A1* | 1/2017 | Park | G09G 3/3208 |
| 2017/0256191 | A1* | 9/2017 | Wen | G09G 3/3258 |
| 2018/0012550 | A1 | 1/2018 | Lim et al. | |
| 2018/0061292 | A1* | 3/2018 | Hong | G09G 3/006 |
| 2018/0308430 | A1 | 10/2018 | Xu | |
| 2019/0164462 | A1 | 5/2019 | Chen | |

FOREIGN PATENT DOCUMENTS

| | | | |
|---|---|---|---|
| CN | 107016964 | A | 8/2017 |
| CN | 107170408 | A | 9/2017 |
| CN | 108520716 | A | 9/2018 |

* cited by examiner

PIXEL CIRCUIT UNIT, DRIVING METHOD THEREOF, DISPLAY PANEL AND DISPLAY DEVICE

CROSS REFERENCE TO RELATED APPLICATIONS

This application is the National Stage of PCT/CN2019/082416 filed on Apr. 12, 2019, which claims priority under 35 U.S.C. § 119 of Chinese Application No. 201810326602.4 filed on Apr. 12, 2018, the disclosure of which is incorporated by reference.

TECHNICAL FIELD

Embodiments of the present disclosure relate to a pixel circuit unit, a driving method thereof, a display panel and a display device.

BACKGROUND

With the continuous improvement of display technology, people's requirement on display devices is also higher and higher. Among the display devices, organic light-emitting diode (OLED) display device has the advantages of self-luminescence, thin and light property, low power consumption, high contrast, large color gamut, capability of realizing flexible display, etc., and thus the OLED display device has been widely used in various electronic devices including computers, mobile phones, etc.

SUMMARY

At least one embodiment of the present disclosure provides a pixel circuit unit, which comprises a plurality of pixel drive circuits and a voltage control circuit. The voltage control circuit comprises a first terminal and a second terminal; the first terminal of the voltage control circuit is connected with a first voltage terminal to receive a first supply voltage provided by the first voltage terminal; each pixel drive circuit comprises a light-emitting drive circuit, and the light-emitting drive circuit comprises a supply voltage receiving terminal and a control terminal; the supply voltage receiving terminal of the light-emitting drive circuit of the each pixel drive circuit is electrically connected with the second terminal of the voltage control circuit, so as to allow the supply voltage receiving terminal of the light-emitting drive circuit of the each pixel drive circuit to be capable of receiving the first supply voltage; and the voltage control circuit is configured to be disconnected in a data voltage writing stage, so that the supply voltage receiving terminal of the light-emitting drive circuit of the each pixel drive circuit does not receive the first supply voltage in the data voltage writing stage.

For example, in at least one example of the pixel circuit unit, the pixel circuit unit further comprises a common line. The second terminal of the voltage control circuit and supply voltage receiving terminals of light-emitting drive circuits of the plurality of pixel drive circuits are all connected with the common line.

For example, in at least one example of the pixel circuit unit, an extension direction of the common line is same with an arrangement direction of the plurality of pixel drive circuits; the common line comprises a first end and a second end; the second terminal of the voltage control circuit is connected with the common line at a first position on the common line; the first position is disposed between the first end of the common line and the second end of the common line, and the first position is a resistance midpoint between the first end and the second end of the common line; and supply voltage receiving terminals of light-emitting drive circuits of two pixel drive circuits, arranged on the outmost, among the plurality of pixel drive circuits are respectively connected with the first end of the common line and the second end of the common line.

For example, in at least one example of the pixel circuit unit, the voltage control circuit comprises a common transistor, and the common transistor comprises a first electrode, a second electrode and a gate electrode; the first electrode of the common transistor, which serves as the first terminal of the voltage control circuit, is connected with the first voltage terminal; the second electrode of the common transistor, which serves as the second terminal of the voltage control circuit is electrically connected with supply voltage receiving terminals of light-emitting drive circuits of the plurality of pixel drive circuits; and the gate electrode of the common transistor is connected with a third scanning signal line to receive a signal provided by the third scanning signal line.

For example, in at least one example of the pixel circuit unit, the light-emitting drive circuit comprises a driving transistor, and the driving transistor comprises a first electrode, a second electrode and a gate electrode; the first electrode of the driving transistor, which serves as the supply voltage receiving terminal of the light-emitting drive circuit, is connected with the voltage control circuit; the second electrode of the driving transistor, which serves as a signal output terminal of the light-emitting drive circuit, is connected with a first node; and the gate electrode of the driving transistor, which serves as the control terminal of the light-emitting drive circuit, is configured to receive a data voltage.

For example, in at least one example of the pixel circuit unit, the light-emitting drive circuit further comprises a switching transistor and a storage capacitor; the switching transistor comprises a gate electrode, a first electrode and a second electrode; the storage capacitor comprises a first terminal and a second terminal; the gate electrode of the switching transistor is connected with a second scanning signal line to receive a signal provided by the second scanning signal line; the first electrode of the switching transistor is connected with a data signal line to receive the data voltage; the second electrode of the switching transistor is connected with a second node and connected with the gate electrode of the driving transistor, and the first terminal of the storage capacitor is connected with the first node, and the second terminal of the storage capacitor is connected with the second electrode of the switching transistor and the second node.

For example, in at least one example of the pixel circuit unit, first electrodes of switching transistors of light-emitting drive circuits of different pixel drive circuits are connected with different data signal lines.

For example, in at least one example of the pixel circuit unit, the each pixel drive circuit further comprises a sensing transistor, and the sensing transistor comprises a first electrode, a second electrode and a gate electrode; the gate electrode of the sensing transistor is connected with a first scanning signal line to receive a signal provided by the first scanning signal line; the first electrode of the sensing transistor is connected with a signal output terminal of the light-emitting drive circuit; except the last pixel drive circuit, the second electrode of the sensing transistor of the each pixel drive circuit is connected with first electrode of sensing transistor of the next pixel drive circuit; and second electrode of sensing transistor of the last pixel drive circuit is connected with a sensing signal line.

For example, in at least one example of the pixel circuit unit, sensing transistors are bottom-gate type transistors.

For example, in at least one example of the pixel circuit unit, the pixel circuit unit comprises three, four or five pixel drive circuits.

For example, in at least one example of the pixel circuit unit, the each pixel drive circuit further comprises a light-emitting diode (LED); and an anode of the LED is connected with a signal output terminal of the light-emitting drive circuit of the pixel drive circuit.

At least one embodiment of the present disclosure provides another pixel circuit unit, which comprises a plurality of pixel drive circuits that are sequentially connected and a voltage control circuit connected with the pixel drive circuits. Each pixel drive circuit comprises: a light-emitting drive circuit, a sensing transistor and an LED; a first electrode of the sensing transistor, the light-emitting drive circuit, and an anode of the LED are connected with each other through a first node; except the last pixel drive circuit, a second electrode of the sensing transistor in the each pixel drive circuit is connected with a first node in the next pixel drive circuit; second electrode of sensing transistor in the last pixel drive circuit is connected with a sensing signal line; gate electrodes of all sensing transistors in the pixel circuit unit are connected with a first scanning signal line; all light-emitting drive circuits in the pixel circuit unit are connected with a second scanning signal line; all the light-emitting drive circuits are connected with a first voltage terminal through the voltage control circuit; the voltage control circuit is connected with a third scanning signal line, so as to control, through the third scanning signal line, whether or not the light-emitting drive circuits are connected with the first voltage terminal; and different light-emitting drive circuits are connected with different data signal lines.

At least one embodiment of the present disclosure provides a driving method for driving the above-mentioned pixel circuit unit, which comprises: providing an invalid signal to a control terminal of the voltage control circuit in a data voltage writing stage, so as to allow the voltage control circuit to be disconnected in the data voltage writing stage, and allow supply voltage receiving terminals of a plurality of light-emitting drive circuits to not receive the first supply voltage in the data voltage writing stage.

For example, in at least one example of the driving method, the voltage control circuit comprises a common transistor, and the common transistor comprises a gate electrode, a first electrode and a second electrode; the first electrode of the common transistor, which serves as the first terminal of the voltage control circuit, is connected with the first voltage terminal; the second electrode of the common transistor, which serves as the second terminal of the voltage control circuit, is electrically connected with the supply voltage receiving terminals of the plurality of light-emitting drive circuits. Providing the invalid signal to the control terminal of the voltage control circuit in the data voltage writing stage comprises: providing the invalid signal to the gate electrode of the common transistor in the data voltage writing stage, so as to disconnect the first terminal of the voltage control circuit and the second terminal of the voltage control circuit.

For example, in at least one example of the driving method, the each pixel drive circuit further comprises a sensing transistor, and the sensing transistor comprises a first electrode, a second electrode and a gate electrode; the gate electrode of the sensing transistor is connected with a first scanning signal line to receive a signal provided by the first scanning signal line; the first electrode of the sensing transistor is connected with a signal output terminal of the light-emitting drive circuit; except the last pixel drive circuit, the second electrode of the sensing transistor of the each pixel drive circuit is connected with a first electrode of a sensing transistor of the next pixel drive circuit; and second electrode of sensing transistor of the last pixel drive circuit is connected with a sensing signal line.

For example, in at least one example of the driving method, a sensing period of the pixel circuit unit comprises a plurality of sensing sub-periods which are configured to respectively detect pixel compensation data of the plurality of pixel drive circuits. The driving method further comprises: in a data voltage writing stage of each sensing sub-period, providing a sensing data voltage to a control terminal of a light-emitting drive circuit of a pixel drive circuit to be detected among the plurality of pixel drive circuits, and providing a turn-off data voltage to control terminals of light-emitting drive circuits of other pixel drive circuits among the plurality of pixel drive circuits, so as to acquire pixel compensation data of the pixel drive circuit to be detected.

For example, in at least one example of the driving method, the driving method further comprises: in a display period of the pixel circuit unit, respectively providing corresponding compensating pixel data to control terminals of light-emitting drive circuits of the plurality of pixel drive circuits, in which the corresponding compensating pixel data are: pixel data obtained through compensating initial pixel data based on corresponding pixel compensation data.

At least one embodiment of the present disclosure provides another driving method for driving the above-mentioned pixel circuit unit, which comprises: in a data voltage writing stage of a sensing period, inputting a first scanning signal into the first scanning signal line, inputting a second scanning signal into the second scanning signal line, inputting an invalid signal into the third scanning signal line, inputting a first reference voltage into the sensing signal line, inputting a sensing data signal into one data signal line among a plurality of data signal lines and storing the sensing data signal, and inputting a turn-off data signal into the remaining data signal lines among the plurality of data signal lines; in a sensing stage of the sensing period, inputting the first scanning signal into the first scanning signal line, inputting an invalid signal into the second scanning signal line, and inputting a third scanning signal into the third scanning signal line, so as to charge the sensing signal line through the first node; in a sampling stage of the sensing period, acquiring pixel compensation data through the sensing signal line; in a data voltage writing stage of a display period, inputting the first scanning signal into the first scanning signal line, inputting the second scanning signal into the second scanning signal line, inputting an invalid signal into the third scanning signal line, inputting a second reference voltage into the sensing signal line, respectively inputting corresponding compensating pixel data into the different data signal lines, and storing the corresponding compensating pixel data, in which the corresponding compensating pixel data are: pixel data obtained through compensating initial pixel data according to corresponding pixel compensation data; and in an effective display stage of the display period, inputting an invalid signal into the first scanning signal line, inputting an invalid signal into the second scanning signal line, and inputting the third scanning signal into the third scanning signal line, so as to control LEDs driven by the pixel circuit unit to emit light according to the corresponding compensating pixel data.

At least one embodiment of the present disclosure provides a display panel, which comprises the pixel circuit unit provided by any one of the embodiments of the present disclosure.

For example, in at least one example of the display panel, the display panel comprises a plurality of subpixels arranged in a matrix; the plurality of pixel drive circuits in the pixel circuit unit are in one-to-one correspondence with the plurality of subpixels; adjacent subpixels of different colors disposed in a same row of subpixels form one of pixel units; a plurality of subpixels in one of the pixel units are in one-to-one correspondence with a plurality of pixel drive circuits in one of pixel circuit units; and each pixel unit comprises a red subpixel, a green subpixel and a blue subpixel; or each pixel unit comprises a red subpixel, a green subpixel, a blue subpixel and a white subpixel; or each pixel unit comprises a red subpixel, a green subpixel, a blue subpixel, a cyan subpixel and a yellow subpixel.

At least one embodiment of the present disclosure still provides the pixel circuit unit or the display panel provided by any one of the embodiments of the present disclosure.

BRIEF DESCRIPTION OF THE DRAWINGS

In order to clearly illustrate the technical solution of the embodiments of the disclosure, the drawings for describing the embodiments or related technologies will be briefly described in the following: it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

As for display devices (e.g., OLED display devices), a pixel drive circuit (e.g., a pixel circuit) needs to be provided for each subpixel to drive an OLED in the subpixel to allow the OLED to emit light, so as to achieve normal display. However, the inventors of the present disclosure have noted during research that some OLED display devices have problems of display inhomogeneity and/or slow compensation speed. Exemplary description will be given below with reference to FIG. 1.

Figure 1:
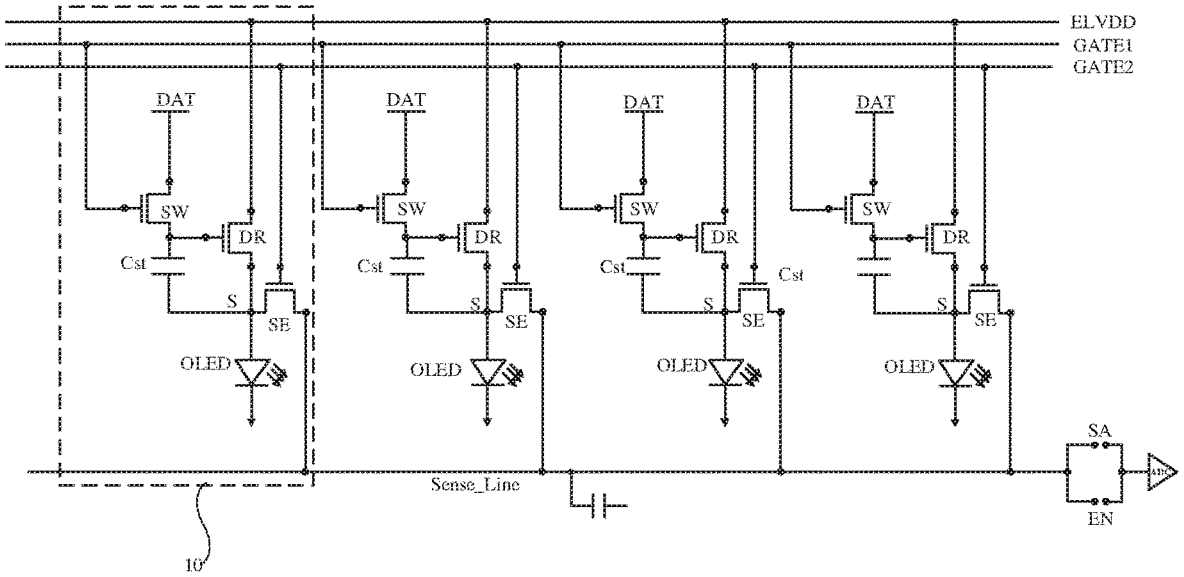
FIG. 1 is a schematic structural view of a pixel drive circuit.

FIG. 1 illustrates a pixel circuit unit of a display device (for example, an OLED display device). As illustrated in FIG. 1, the pixel circuit unit comprises a plurality of pixel drive circuits 10. The pixel drive circuit is, for example, a 3T1C pixel circuit, namely a pixel circuit including 3 transistors and 1 capacitor. As illustrated in FIG. 1, the pixel drive circuit comprises a switching transistor SW, a driving transistor DR, a sensing transistor SE and a storage capacitor Cst. For the convenience of description, light-emitting elements OLED are also illustrated in the pixel drive circuit as illustrated in FIG. 1.

As illustrated in FIG. 1, a second electrode of the driving transistor DR, a first electrode of the sensing transistor SE, a first terminal of the storage capacitor Cst, and an anode of the light-emitting element OLED are all connected to a first node S; a first electrode of the driving transistor DR is connected with a first voltage terminal; a gate electrode of the switching transistor SW is connected with a first scanning signal line; a gate electrode of the sensing transistor SE is connected with a second scanning signal line; a cathode of the light-emitting element OLED may be connected with a second voltage terminal (not illustrated in the figure); and the second voltage provided by the second voltage terminal is less than the first voltage provided by the second voltage terminal.

For example, as illustrated in FIG. 1, a plurality of sensing transistors SE in the plurality of pixel drive circuits 10 may be respectively connected to a sensing line Sense_Line, and the sensing line Sense_Line has parasitic capacitance (not illustrated in the figure). One end of the sensing line Sense_Line may be connected to a reference voltage terminal or an analog-to-digital converter (ADC). For example, in the data voltage writing stage of the pixel circuit unit, the one end of the sensing line Sense_Line may be connected with the reference voltage terminal to write the reference voltage (for example, the standard voltage Vref as described below) provided by the reference voltage terminal into the first node S; and in the sensing signal sampling stage of the pixel circuit unit, the one end of the sensing line Sense_Line may be connected with the ADC to convert a sensing signal (an analog signal) acquired from the first node S into a digital signal.

In actual display of the display device, because the characteristics of thin-film transistors (TFTs) (e.g., driving transistors) change or different driving transistors have different characteristics, display abnormality (e.g., display inhomogeneity) can be presented in the OLED display device. Thus, in the related art, compensation may be performed with respect to the pixel drive circuits in the subpixels (for example, an electrical compensation method is adopted to compensate the threshold voltages of the driving transistors of the pixel drive circuits). As illustrated in FIG. 1, the sensing signal line Sense_Line and the sensing transistors SE may be controlled to compensate the threshold voltages of the driving transistors in the pixel drive circuits of the pixel circuit unit, so as to reduce display inhomogeneity.

Figure 5:
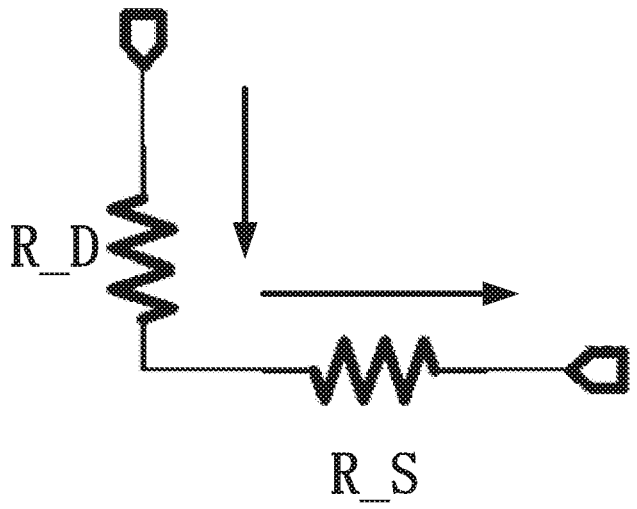
FIG. 5 is an equivalent circuit of a voltage terminal, a driving transistor and a sensing transistor provided by an embodiment of the present disclosure

However, the inventors of the present disclosure have noted that the voltage of the first node S of the pixel circuit unit as illustrated in FIG. 1 is inaccurate and/or unfixed. The reasons are specifically analyzed as follows. When the voltage is written into the first node S of the pixel circuit unit as illustrated in FIG. 1, because the plurality of pixel drive circuits 10 in the pixel circuit unit are respectively and directly connected with the first voltage terminal ELVDD through different driving transistors DR, in this case, at the moment when pixel data are written through the switching transistors SWs respectively, current is generated in the driving transistors DR. For example, the generated current flows from the driving transistor DR to a sensing module (e.g., a sensing integrated chip (IC)) or a reference voltage terminal (for example, the voltage level of the sensing module or the reference voltage terminal is the standard voltage Vref) via the sensing transistor SE and the sensing line. For example, the generated current may also flow across the light-emitting element OLED. In this case, an equivalent circuit of the voltage terminal ELVDD, the driving transistor DR and the sensing transistor SE is illustrated in FIG. 5 (R_D and R_S as illustrated in FIG. 5 are respectively the equivalent resistance of the driving transistor DR and the equivalent resistance of the sensing transistor SE), that is, the driving transistor DR and the sensing transistor SE performs voltage division on the voltage difference between the first voltage terminal ELVDD and the sensing module, so that the voltage of the first node S (the anode voltage of OLED) can be unequal to the standard voltage Vref provided by the sensing module or the reference voltage terminal through Sense_Line (the voltage of the first node S is greater than the standard voltage Vref), and then the grayscale actually displayed by the display pixels of the pixel circuit unit can be inaccurate. The inventors of the present disclosure have also noted that the voltage of the first node S (the anode voltage of OLED) can also be increased along with the increase of the data voltage (the reason is that the driving current is increased along with the increase of the data voltage), so that the voltage of the first node S can be unfixed, and then the inaccurate problem of the grayscale displayed by the display pixels of the pixel circuit unit can be worsened.

In addition, the inventors of the present disclosure have also noted that, because the plurality of pixel drive circuits 10 in the pixel circuit unit are respectively connected with the same Sense_Line through different sensing transistors SE by means of parallel connection, and the sensing transistor SE has certain parasitic capacitance (gate-source capacitance Cgs, gate-drain capacitance Cgd), the overall capacitance on the Sense_Line can be increased, and then the time required for charging the capacitor on the Sense_Line to a target capacitance can be increased. Thus, the actual compensation speed can be reduced, thereby restricting the ability to improve the non-uniformity problem of display images by electrical compensation methods.

At least one embodiment of the present disclosure provides a pixel circuit unit, which comprises a plurality of pixel drive circuits and a voltage control circuit. The voltage control circuit comprises a first terminal and a second terminal; the first terminal of the voltage control circuit is connected with a first voltage terminal to receive a first supply voltage provided by the first voltage terminal; each pixel drive circuit comprises a light-emitting drive circuit, and the light-emitting drive circuit comprises a supply voltage receiving terminal and a control terminal; the supply voltage receiving terminal of the light-emitting drive circuit of the each pixel drive circuit is electrically connected with the second terminal of the voltage control circuit, so as to allow the supply voltage receiving terminal of the light-emitting drive circuit of the each pixel drive circuit to be capable of receiving the first supply voltage; and the voltage control circuit is configured to be disconnected in a data voltage writing stage, so that the supply voltage receiving terminal of the light-emitting drive circuit of the each pixel drive circuit does not receive the first supply voltage in the data voltage writing stage.

Non-limitative descriptions are given to the pixel circuit unit provided by the embodiments of the present disclosure in the following with reference to a plurality of examples. As described in the following, in case of no conflict, different features in these specific examples may be combined so as to obtain new examples, and the new examples are also fall within the scope of present disclosure.

Figure 2:
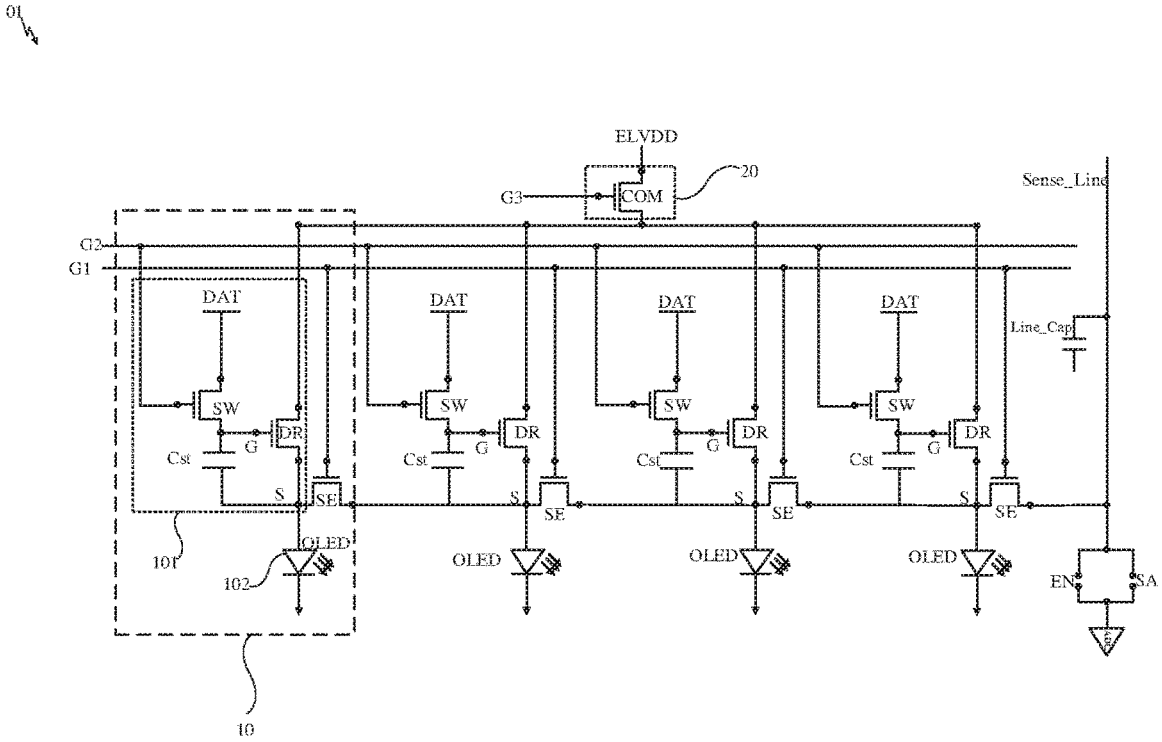
FIG. 2 is a schematic structural view of a pixel circuit unit provided by an embodiment of the present disclosure.
Figure 6:
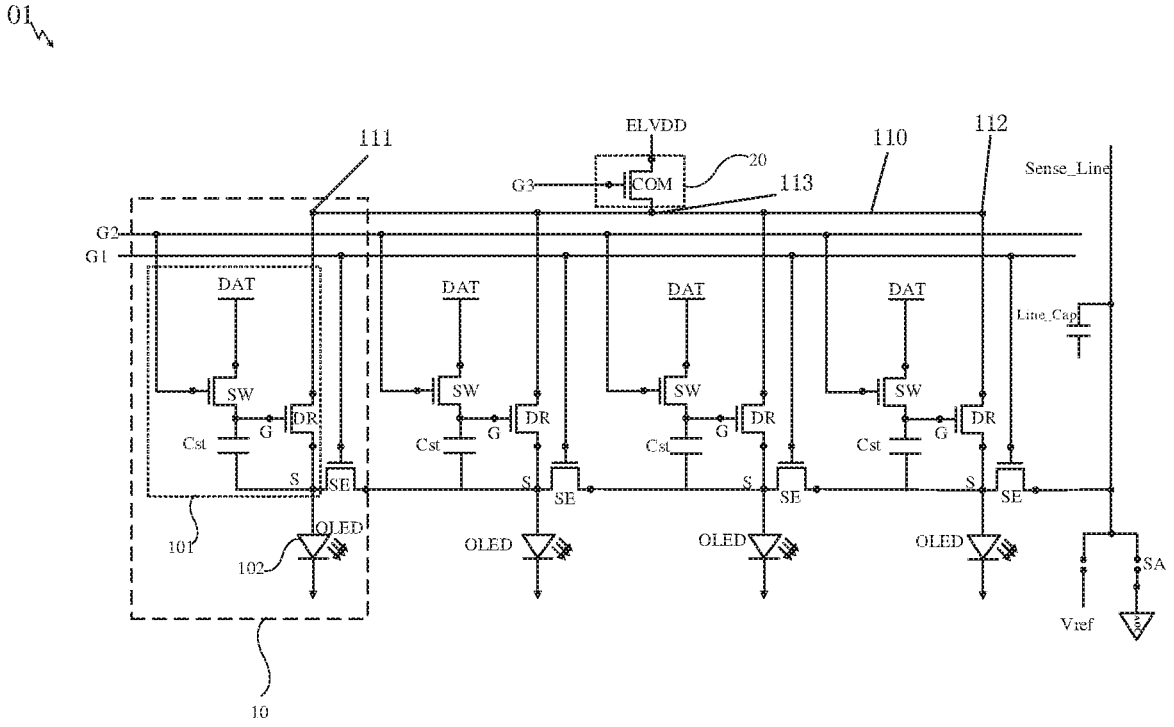
FIG. 6 is another schematic structural view of a pixel circuit unit provided by an embodiment of the present disclosure.

An embodiment of the present disclosure provides a pixel circuit unit. FIG. 2 is a schematic diagram of the pixel circuit unit provided by an embodiment of the present disclosure. FIG. 6 is another schematic diagram of the pixel circuit unit provided by an embodiment of the present disclosure.

As illustrated in FIGS. 2 and 6, the pixel circuit unit 01 comprises a plurality of pixel drive circuits 10 sequentially connected and a voltage control module 20 (for example, a voltage control circuit) connected with the plurality of pixel drive circuits 10. Description of FIG. 2 is given by taking the case where the pixel circuit unit 01 comprises four pixel drive circuits 10 as an example, but the embodiments of the present disclosure are not limited thereto. For example, the pixel circuit unit 01 may also comprise three, five or other appropriate numbers of pixel drive circuits 10. The embodiments of the present disclosure will be further described with reference to the following examples by taking the case where the pixel circuit unit 01 in FIG. 2 comprises four pixel drive circuits 10 as an example.

As illustrated in FIGS. 2 and 6, each pixel drive circuit 10 includes: a light-emitting drive module 101 (e.g., a light-emitting drive circuit), a sensing transistor SE and an LED 102 (namely an OLED); a first electrode of the sensing transistor SE, the light-emitting drive module 101 and an anode of the LED 102 are connected with each other through a first node S. In some examples, the pixel circuit unit may also not comprise the LED 102. For example, the above-mentioned four pixel drive circuits 10 may be respectively configured to drive an LED that emits red light, an LED that emits green light, an LED that emits blue light, and an LED that emits white light. It should be noted that the pixel circuit unit may also be used for driving other suitable light-emitting elements. In this case, an anode terminal of the light-emitting element is connected with the first node S.

As illustrated in FIGS. 2 and 6, the plurality of sensing transistors SE in the plurality of pixel drive circuits 10 may be connected to the sensing line Sense_Line after being connected in series. As illustrated in FIG. 2, except the last pixel drive circuit 10, second electrodes of the sensing transistors SE of all the pixel drive circuits 10 in the plurality of pixel drive circuits 10 are connected with the first node S of the next pixel drive circuit 10, and the second electrode of the sensing transistor SE in the last pixel drive circuit 10 is connected with the sensing signal line Sense_Line. That is to say, the sensing transistors SE in the sequentially arranged pixel drive circuits 10 of the pixel circuit unit 01 adopt a series connection structure, and a source electrode of one sensing transistor SE in the plurality of sensing transistors SE of the plurality of pixel drive circuits 10 is connected with a drain electrode of an adjacent sensing transistor SE.

For example, because the sensing transistors in the pixel drive circuits are set to be connected with the sensing signal line by means of series connection, the capacitance on the sensing signal line is reduced, and thus the compensation speed is improved. For example, in the case where each sensing line is connected with M sensing transistors SE, the gate-source capacitance of each sensing transistor is Cgs, and the M sensing transistors SE are respectively connected to each sensing line, the gate-source capacitance of the sensing transistors on each sensing line is M×Cgs. In the case the M sensing transistors SE are connected to each sensing line after being connected in series, the gate-source capacitance of the sensing transistors on each sensing line is Cgs. Thus, because the sensing transistors in the pixel drive circuits are set to be connected with the sensing signal line by means of series connection, the capacitance on the sensing signal line is reduced.

For example, as illustrated in FIG. 6, there is parasitic capacitance Line_Cap on the sensing line Sense_Line; one end of the sensing line Sense_Line may be connected to a reference voltage terminal Vref or an ADC; a switch EN is disposed between the one end of the sensing line Sense_Line and the reference voltage terminal Vref; and a switch SA is disposed between the one end of the sensing line Sense_Line and the ADC. For example, in the data voltage writing stage of the pixel circuit unit, the switch EN can be switched on, and the one end of the sensing line Sense_Line is connected with the reference voltage terminal, so as to write the reference voltage provided by the reference voltage terminal into the first node S. In the sensing signal sampling stage of the pixel circuit unit, the switch SA can be switched on, and the one end of the sensing line Sense_Line is connected with the ADC, so as to convert a sensing signal (an analog signal) acquired from the first node S into a digital signal.

For example, as illustrated in FIGS. 2 and 6, in the pixel circuit unit 01, gate electrodes of all the sensing transistors SE may be all connected with a first scanning signal line G1 to receive a signal (e.g., a first scanning signal) provided by the first scanning signal line G1, and the signal provided by the first scanning signal line G1 may be configured to control the conduction state (on or of) of the plurality of sensing transistors SE. For example, the first scanning signal is a valid signal (valid voltage level). It should be noted that, in at least one example of the present disclosure, the valid signal (valid voltage level) refers to a signal (voltage level) that switches on the transistor receiving the valid signal (valid voltage level).

For example, as illustrated in FIGS. 2 and 6, all the light-emitting drive modules 101 are connected with a second scanning signal line G2 to receive a signal (e.g., a second scanning signal) provided by the second scanning signal line G2; all the light-emitting drive modules 101 are electrically connected with the first voltage terminal ELVDD through the voltage control module 20; and the voltage control module 20 is connected with a third scanning signal line G3 to control the conduction state (on or off) between the light-emitting drive module 101 and the first voltage terminal ELVDD in response to a signal (e.g., a third scanning signal) provided by the third scanning signal line G3. For example, both the first scanning signal and the third scanning signal are a valid signal (valid voltage level). For example, different light-emitting drive modules 101 may be connected with different data signal lines DAT.

For example, by allowing the gate electrodes of all the sensing transistors SE to be all connected with the first scanning signal line G1 and/or allowing all the light-emitting drive modules 101 to be connected with the second scanning signal line G2, the size of a wiring area can be reduced and the circuit structure can be simplified. In spite of this, the gate electrodes of all the sensing transistors SE are not limited to be connected with the same first scanning signal line G1, and the gate electrodes of different sensing transistors SE may also be connected with different first scanning signal lines as long as the signals provided by the different first scanning signal lines are the same with each other. Similarly, different light-emitting drive modules 101 may be all connected with different second scanning signal lines G2 as long as the signals provided by different second scanning signal lines G2 are the same with each other.

In some examples, compared with the technical solution that the light-emitting drive module as illustrated in FIG. 1 is directly connected with the first voltage terminal and the sensing transistors in the pixel drive circuits are connected with the sensing signal line by means of parallel connection, in which the technical solution can cause the problems of possible error (inaccurate actual light-emitting brightness) of the anode voltage of the LED and low compensation speed caused by overlarge capacitance on the sensing signal line due to the parasitic capacitance of the sensing transistors, by arrangement of the voltage control module between the light-emitting drive module and the first voltage terminal, the embodiments of the present disclosure avoids or reduces the error of the anode voltage of the LED and allows the actual light-emitting brightness of the LED to be more accurate. Moreover, by allowing the sensing transistors in the pixel drive circuits to be connected with the sensing signal line by means of series connection, the capacitance on the sensing signal line is reduced, and thus the compensation speed is improved. That is to say, the pixel circuit unit provided by some examples of the present disclosure can accurately and rapidly perform effective electrical compensation on subpixels.

Further description will be given below to the specific setting structure of the voltage control module 20 and the light-emitting drive module 101.

In some examples, as illustrated in FIG. 2, the voltage control module 20 may include a common transistor COM. A gate electrode of the common transistor COM is connected with a third scanning signal line G3 to receive a signal provided by the third scanning signal line G3; a first electrode of the common transistor COM is taken as a first terminal of the voltage control circuit and connected with the first voltage terminal ELVDD to receive the first voltage provided by the first voltage terminal ELVDD; and a second electrode of the common transistor COM is taken as a second terminal of the voltage control circuit and connected with all the light-emitting drive modules 10 (supply voltage receiving terminals of all the light-emitting drive modules 10) in the pixel circuit unit 01, so that the supply voltage receiving terminals of all the light-emitting drive modules 10 can receive the first supply voltage. The common transistor COM is configured to control whether to provide the first voltage provided by the first voltage terminal ELVDD to the supply voltage receiving terminals of all the light-emitting drive modules 10 in the pixel circuit unit 01 in response to the signal provided by the third scanning signal line G3. For example, when the signal provided by the third scanning signal line G3 is a valid signal (e.g., the third scanning signal), the common transistor COM is configured to provide the first voltage provided by the first voltage terminal ELVDD to the supply voltage receiving terminals of all the light-emitting drive modules 10 in the pixel circuit unit 01; and when the signal provided by the third scanning signal line G3 is an invalid signal, the common transistor COM is configured to not provide the first voltage provided by the first voltage terminal ELVDD to the supply voltage receiving terminal of any light-emitting drive modules 10 in the pixel circuit unit 01.

For example, the on-off between the light-emitting drive modules 101 and the first voltage terminal ELVDD may also be controlled by arranging a transistor specifically for each light-emitting drive module. In actual application, in order to simplify the manufacturing process and reduce the production cost, the above-mentioned setting mode of connecting one common transistor COM with all the light-emitting drive modules 101 may be adopted.

In addition, it should be understood that, as for the light-emitting drive module 101, in actual application, the light-emitting brightness of the LED connected with a signal output terminal of the light-emitting drive module 101 may be controlled by control of the intensity of the driving current generated in the light-emitting drive module 101. For another example, the light-emitting brightness may also be controlled by control of the voltage of the anode (namely the first node) of the LED by controlling the light-emitting drive module 101. For example, the light-emitting drive module 101 may be implemented as a 2T1C (namely two transistors and one storage capacitor) circuit structure, and may also be implemented as a 3T1C circuit structure or other appropriate circuit structures according to actual demands. No specific limitation will be given in the embodiments of the present disclosure regarding the specific setting mode of the light-emitting drive module 101.

Illustratively, embodiments of the present disclosure provides a light-emitting drive module implemented as a 2T1C circuit. As illustrated in FIGS. 2 and 6, the light-emitting drive module includes a switching transistor SW, a driving transistor DR and a storage capacitor Cst.

As illustrated in FIGS. 2 and 6, a gate electrode of the switching transistor SW is connected with a second scanning signal line G2 to receive a signal (e.g., a second scanning signal) provided by the second scanning signal line; a first electrode of the switching transistor SW is connected with a data signal line DAT to receive a data voltage (e.g., sensing data voltage, turn-off data voltage or compensating pixel voltage); and a second electrode of the switching transistor SW is connected with a second node G.

As illustrated in FIGS. 2 and 6, the gate electrode (taken as a control terminal of the light-emitting drive circuit) of the driving transistor DR is connected with the second node G and the second electrode of the switching transistor, and the gate electrode of the driving transistor DR is configured to receive the data voltage (e.g., sensing data voltage, turn-off data voltage or compensating pixel voltage); the first electrode of the driving transistor DR is taken as the supply voltage receiving terminal of the light-emitting drive circuit and connected with the second terminal of the voltage control module (for example, the second electrode of the above-mentioned common transistor COM); and the second electrode of the driving transistor DR is taken as the signal output terminal of the light-emitting drive circuit and connected with the first node S.

As illustrated in FIGS. 2 and 6, the first terminal of the storage capacitor Cst is connected with the first node S, and the second terminal of the storage capacitor Cst is connected with the second electrode of the switching transistor and the second node G.

For example, the voltage control circuit is configured to be disconnected in the data voltage writing stage, so that the supply voltage receiving terminal of the light-emitting drive circuit does not receive the first supply voltage in the data voltage writing stage. For example, in the data voltage writing stage, a valid signal may be provided to the gate electrode of the sensing transistor SE through the first scanning line G1; a valid signal may be provided to the gate electrode of the switching transistor SW through the second scanning line G2; and an invalid signal may be provided to the control terminal of the voltage control circuit through the third scanning line G3. In this case, the data voltage (e.g., the sensing data voltage, the turn-off data voltage or the compensating pixel voltage) received by the first terminal of the switching transistor SW may be provided to the gate electrode of the driving transistor DR through the switching transistor SW which is switched on, and the reference voltage provided by the reference voltage terminal may be provided to the second electrode of the driving transistor DR through the sensing signal line and the sensing transistor SE which is switched on. Because the voltage control circuit is disconnected, the supply voltage receiving terminal of the light-emitting drive circuit cannot receive the first supply voltage in the data voltage writing stage, so no driving current is generated in the driving transistor DR. Thus, the voltage of the first node S is irrelevant to the data voltage received by the first terminal of the switching transistor SW and the gate electrode of the driving transistor DR, and the voltage difference between the gate electrode and the second electrode of the driving transistor DR is more accurate, thereby improving the grayscale accuracy of the display pixels of the pixel circuit unit and the brightness accuracy of the display panel and the display device that are includes the pixel circuit unit.

For example, as illustrated in FIG. 6, the pixel circuit unit further comprises a common line 110. A second terminal (for example, the second electrode of the common transistor COM) of the voltage control circuit and the supply voltage receiving terminals (for example, the first electrodes of the driving transistors DR) of the light-emitting drive circuits of the plurality of pixel drive circuits are all connected with the common line 110. For example, by allowing the pixel circuit unit to comprise the common line 110 as well, the wiring design of the pixel circuit unit can be simplified.

For example, as illustrated in FIG. 6, the extension direction of the common line 110 may be the same with the arrangement direction of the plurality of pixel drive circuits 10 (for example, all along the horizontal direction as illustrated in FIG. 6). For example, as illustrated in FIG. 6, the common line 110 includes a first end 111 and a second end 112; the second terminal of the voltage control circuit is connected with the common line 110 at a first position 113 on the common line; the first position is disposed between the first end of the common line and the second end of the common line; the supply voltage receiving terminals of two pixel drive circuits, arranged on the outmost, among the plurality of pixel drive circuits are respectively connected with the first end of the common line and the second end of the common line; and the supply voltage receiving terminals of the remaining pixel drive circuits among the plurality of pixel drive circuits are respectively connected with the common line at positions between the first end of the common line and the second end of the common line.

For example, as illustrated in FIG. 6, the first position may be a resistance midpoint between the first end and the second end of the common line. It should be noted that in some embodiments of the present disclosure, the "resistance midpoint" refers to a point that is between two points on a line and makes the resistances between the point to the two points equal. For example, as illustrated in FIG. 6, the first end and the second end of the common line may be two physical end portions of the common line, but the embodiments of the present disclosure are not limited thereto. The first end and the second end of the common line may also be disposed between two physical end portions of the common line. For example, as illustrated in FIG. 6, the first position of the common line may be a physical midpoint of the common line, that is, a point on the common line which has equal distance to both the first end and the second end of the common line.

For example, by allowing the first position to be the resistance midpoint between the first end and the second end of the common line, the voltage received by the supply voltage receiving terminals of the light-emitting drive circuits of the plurality of pixel drive circuits can be closer in the case of simplifying the wiring design of the pixel circuit unit, thereby further improving the display uniformity of the display panel and the display device that are includes the pixel circuit unit.

Further analysis will be given below to relevant advantages of the pixel circuit unit in some embodiments of the present disclosure by comparison with the pixel circuit unit in FIG. 1.

Firstly, the sensing transistor SE may be a bottom-gate type transistor and may also be a top-gate type transistor, which is not limited here in the embodiments of the present disclosure. But both the bottom-gate type transistor and the top-gate type transistor have parasitic capacitance.

For example, in the case where the sensing transistor SE is a bottom-gate type transistor, due to the alignment error between the source electrode and the gate electrode and the alignment error between the source electrode and the drain electrode, taking into account the critical dimension bias (CD BIAS), that are caused by a wet etching process, of patterns, and in order to ensure that there is no non-overlapping area between the source electrode and the gate electrode and there is no non-overlapping area between the source electrode and the drain electrode, in actual application, large overlap areas are allowed to be existed the source/drain electrodes and the gate electrodes in design, so that the parasitic gate-source capacitance Cgs and the gate-drain capacitance Cgd in the transistor can be relatively large. For example, when the sensing transistor SE is a top-gate type transistor, there are parasitic gate-source capacitance Cgs and parasitic gate-drain capacitance Cgd (smaller than those of the bottom-gate type) in the transistor as well due to the accuracy problem of the conductorized process.

For example, when the pixel circuit unit (FIGS. 1 and 2) is in normal working state, the parasitic capacitance CSense on the sensing signal line Sense_Line satisfies the following expression:

$$C_{Sense}=C_{Line}+C_{SE\text{-}Cgs}$$

Here, $C_{Line}$ refers to the capacitance formed at a position where the sensing signal line Sense_Line and other metallic conductors are overlapped; and $C_{SE\text{-}Cgs}$ refers to the parasitic capacitance (at least one of Cgs or Cgd) of the sensing transistors SE connected with the sensing signal line Sense_Line.

In this case, in the case where the sensing transistors SE in the four pixel drive circuits (the four pixel drive circuits am a first pixel drive circuit, a second pixel drive circuit, a third pixel drive circuit and a fourth pixel drive circuit from left to right) of the pixel circuit unit as illustrated in FIG. 1 are connected with the sensing signal line Sense_Line by means of parallel connection, the parasitic capacitance CSense on the sensing signal line Sense_Line satisfies the following expression: $C_{SE\text{-}Cgs}=C_{SE1\text{-}Cgs}+C_{SE2\text{-}Cgs}+C_{SE3\text{-}Cgs}+C_{SE4\text{-}Cgs}$, that is, the parasitic capacitance $C_{SE1\text{-}Cgs}$, $C_{SE2\text{-}Cgs}$, $C_{SE3\text{-}Cgs}$ and $C_{SE4\text{-}Cgs}$ of the four sensing transistors SE of the four pixel drive circuits in the pixel circuit unit are all loaded to the sensing signal line Sense_Line (taken as a part of the parasitic capacitance CSense on the sensing signal line Sense_Line).

By contrast, in the case where the sensing transistors SE in the four pixel drive circuits of the pixel circuit unit as illustrated in FIG. 2 are connected with the sensing signal line Sense_Line by means of series connection, $C_{SE\text{-}Cgs}=C_{SE4\text{-}Cgs}$, that is, in the four sensing transistors SE of the four pixel drive circuits of the pixel circuit unit, only the parasitic capacitance of one sensing transistor SE (for example, the fourth one from left to right in FIG. 2) connected with the sensing signal line Sense_Line are loaded to the sensing signal line Sense_Line, and the parasitic capacitance of other sensing transistors SE will not be loaded to the sensing signal line Sense_Line.

As can be seen from above, compared with the pixel circuit unit as illustrated in FIG. 1, by adoption of the design proposal of the pixel circuit unit in some embodiments of the present disclosure, the parasitic capacitance of the sensing transistors SE connected with the sensing signal line Sense_Line can be reduced by about 75%. For example, because the parasitic capacitance of the sensing transistors SE occupies more than 50% of the overall parasitic capacitance on the sensing signal line Sense_Line in the case where the bottom-gate sensing transistors SE are adopted, the pixel circuit unit including the bottom-gate sensing transistors SE is particular applicable to the design proposal of the embodiments of the present disclosure. For example, as for two kinds of pixel circuit units as illustrated in FIGS. 1 and 2, $C_{Line}$ of both are approximately equal. In this case, because the parasitic capacitance on the sensing signal line Sense_Line is reduced, the capacitance (Line Cap) on the sensing signal line Sense_Line can be reduced, and then the charging speed of the sensing signal line Sense_Line is improved, namely the compensation speed is improved.

Here, it should be understood that in actual display process, the display period of one frame generally includes a display period with display voltage and a blank period without display voltage; the charging process (namely the sensing process) of the sensing signal line Sense_Line is executed in the blank period; and when the frequency of being charged to the target voltage within this blank period is higher, the compensation speed can be higher.

For example, as for the pixel circuit unit as illustrated in FIG. 1, because the time of being charged to the target voltage is longer in the case where the capacitance on the sensing signal line Sense_Line is larger, for example, only one charge process can be performed within one blank period, that is, the sensing of one pixel drive circuit in the pixel circuit unit can be completed. By contrast, because the capacitance on the sensing signal line Sense_Line as illustrated in FIGS. 2 and 6 is smaller, the time of being charged to the target voltage is shorter, a plurality of (e.g., four or more) charge process can be completed within one blank period, that is, the sensing of four pixel drive circuits in the pixel circuit unit can be completed within one blank period.

It should be also noted that in the pixel circuit unit as illustrated in FIG. 1, because the driving transistor DR is directly connected with the first voltage terminal ELVDD, at the moment of writing the data voltage (e.g., pixel data) through the data signal line DAT, current is generated in the driving transistor DR. For example, the generated current flows from the driving transistor DR to the sensing module (e.g., a sensing integrated chip) or the reference voltage terminal (for example, the voltage level of the sensing module or the reference voltage terminal is the standard voltage Vref) via the sensing transistor SE and the sensing line. For example, the generated current may also flow across the light-emitting element OLED, and the driving transistor DR and the sensing transistor SE perform voltage division on the voltage difference between the first voltage terminal ELVDD and the sensing module, so that the voltage of the first node S (the anode voltage of the OLED) is unequal to the standard voltage Vref provided by the sensing module or the reference voltage terminal through the Sense_Line (the voltage of the first node S is greater than the standard voltage Vref), and then the grayscale actually displayed by the display pixels of the pixel circuit unit can be inaccurate. For example, as illustrated in FIGS. 2 and 6, in the pixel circuit unit in some embodiments of the present disclosure, the driving transistor DR is connected with the first voltage terminal ELVDD through the common transistor COM, and the conduction between the driving transistor DR and the first voltage terminal ELVDD is controlled through the common transistor COM, thereby avoiding or suppressing the problem of inaccurate compensation signals acquired in the sensing period and/or inaccurate gate-source voltage in the writing stage caused by the change (or unfixed) of the voltage of the first node S in the pixel circuit unit as illustrated in FIG. 1, and finally relieving the problem of inaccurate display grayscale.

For example, in some embodiments of the present disclosure, because the driving transistor DR is connected with the first voltage terminal ELVDD through the common transistor COM, in the process of writing the pixel data (e.g., data voltage) via the data signal line DAT, the common transistor COM may be in a turn-off state, and in this case, no current flows across the driving transistor DR, and the voltage of the first node S is irrelevant to the pixel data (e.g., the data voltage) written via the data signal line DAT. For example, the voltage of the first node S may be a fixed voltage, so the accuracy of writing the display grayscale is improved. For example, the voltages of the first nodes S of all the pixel drive circuits 10 are all fixed voltages, and the voltages of the first nodes S of different pixel drive circuits 10 are different from each other.

The following points should be noted.

(1) In the case of low requirement on the compensation speed, the plurality of sensing transistors as illustrated in FIGS. 2 and 6 are not required to be connected to the sensing signal line after being connected in series. In this case, the second electrodes of the plurality of sensing transistors as illustrated in FIGS. 2 and 6 may be respectively connected to the sensing signal line. Correspondingly, the plurality of pixel drive circuits 10 in the pixel circuit unit 01 are arranged in parallel and not required to be sequentially connected.

(2) The pixel circuit unit 01 is not limited to comprise a plurality of pixel drive circuits 10. According to actual application demands, the pixel circuit unit 01 may also only comprise one pixel drive circuit 10 provided by the embodiments of the present disclosure. In this case, the compensation effect of the pixel circuit unit 01 can be still improved to a certain degree. For example, the pixel circuit unit 01 may further comprise a plurality of relevant pixel circuits. The plurality of relevant pixel circuits are directly connected with the first voltage terminal.

(3) The supply voltage receiving terminals of the light-emitting drive circuits of the plurality of pixel drive circuits in some embodiments of the present disclosure and the second terminal of the voltage control circuit 20 are not limited to be all connected to the common line 110. In the case of low voltage drop between the supply voltage receiving terminals of the light-emitting drive circuits and the voltage control circuit 20, the common line 110 may also be not arranged. In this case, the supply voltage receiving terminals of the light-emitting drive circuits of the plurality of pixel drive circuits 10 are directly connected to the second terminal of the voltage control circuit 20.

(4) The voltage control circuit 20 is not limited to be implemented as the common transistor and may also be implemented as a circuit having the function of controlling whether the second terminal of the voltage control circuit 20 is electrically connected with the supply voltage receiving terminal of the light-emitting drive circuit of the pixel drive circuit 10.

(5) The pixel drive circuit 10 in some embodiments of the present disclosure is not limited to the 3T1C pixel circuit as illustrated in FIGS. 2 and 6, and according actual application demands, may also be implemented as a 3T2C pixel circuit, a 7T1C pixel circuit or other suitable pixel circuits, as long as the supply voltage receiving terminal of the light-emitting drive circuit of the pixel drive circuit 10 is electrically connected with the first voltage terminal through the voltage control circuit.

(6) In some embodiments of the present disclosure, for the convenience of description, Vref not only refers to the reference voltage terminal but also refers to the reference voltage.

At least one embodiment of the present disclosure further provides another pixel circuit unit, which comprises a plurality of pixel drive circuits. Each pixel drive circuit includes a light-emitting drive circuit and a sensing transistor. The light-emitting drive circuit includes a signal output terminal. The sensing transistor includes a first electrode, a second electrode and a gate electrode. The gate electrode of the sensing transistor is connected with a first scanning signal line to receive a signal provided by the first scanning signal line; the first electrode of the sensing transistor is connected with the signal output terminal of the light-emitting drive circuit; except the last pixel drive circuit, the second electrode of the sensing transistor of each pixel drive circuit is connected with the first electrode of the sensing transistor of the next pixel drive circuit; and the second electrode of the sensing transistor of the last pixel drive circuit is connected with a sensing signal line.

At least one embodiment of the present disclosure provides a driving method of a pixel circuit unit, which comprises: providing an invalid signal to a control terminal of a voltage control circuit in a data voltage writing stage, so as to allow the voltage control circuit to be disconnected in the data voltage writing stage, and allow a supply voltage receiving terminal of a light-emitting drive circuit to not receive a first supply voltage in the data voltage writing stage.

For example, providing the invalid signal to the control terminal of the voltage control circuit in the data voltage writing stage includes: providing an invalid signal to the gate electrode of a common transistor in the data voltage writing stage so as to disconnect the first terminal of the voltage control circuit and the second terminal of the voltage control circuit.

For example, the sensing period of the pixel circuit unit includes a plurality of sensing sub-periods. The plurality of sensing sub-periods are configured to respectively detect pixel compensation data of the plurality of pixel drive circuits. The driving method comprises: in the data voltage writing stage of each sensing sub-period, providing a sensing data voltage to the control terminal of the light-emitting drive circuit of the pixel drive circuit to be detected among the plurality of pixel drive circuits, and providing a turn-off data voltage to the control terminals of the light-emitting drive circuits of other pixel drive circuits among the plurality of pixel drive circuits. For example, the turn-off data voltage refers to a voltage that drives the light-emitting drive circuit (driving transistor) to be switched off, and is, for example, an invalid voltage.

For example, the driving method further comprises: respectively providing compensating pixel data to the control terminals of the light-emitting drive circuits of the plurality of pixel drive circuits in the display period of the pixel circuit unit. The compensating pixel data of each light-emitting drive circuit is pixel data obtained through compensating initial pixel data based on the pixel compensation data.

Figure 3:
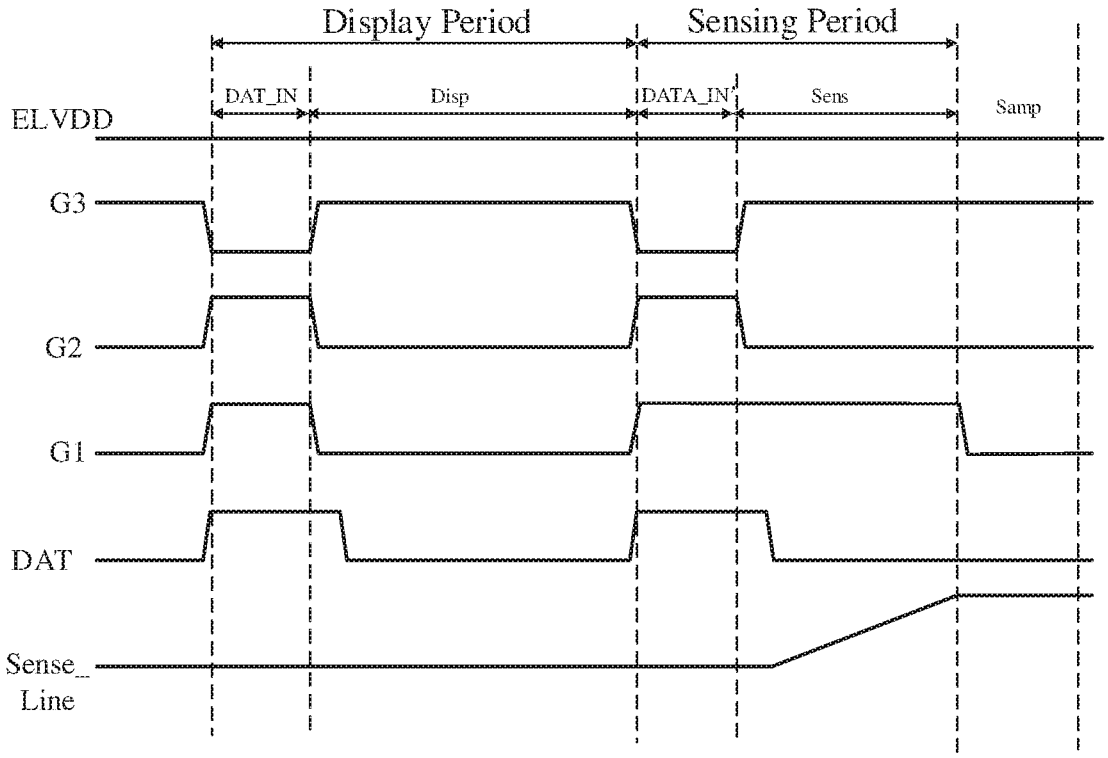
FIG. 3 is a drive timing diagram of a pixel circuit unit provided by an embodiment of the present disclosure.

Exemplary description will be given below to an example of a driving method of a pixel circuit unit provided by at least one embodiment of the present disclosure with reference to FIG. 3. FIG. 3 is a drive timing diagram of the pixel circuit unit as illustrated in FIGS. 2 and 6.

As illustrated in FIG. 3, the pixel circuit unit includes a display period and a sensing period. The sensing period includes a plurality of sensing sub-periods. Each sensing sub-period is configured to detect the pixel compensation data of one pixel drive circuit (for example, the threshold voltage of the driving transistor of one pixel drive circuit) among the plurality of pixel drive circuits. For example, each sensing sub-period includes a data writing stage, a sensing stage and a sampling stage. It should be noted that for clarity, FIG. 3 only illustrates one sensing sub-period (namely the sensing period as illustrated in FIG. 3) of the sensing period. For example, the plurality of sensing sub-periods are sequentially arranged in time (for example, continuously arranged).

The driving method comprises the following steps S101, S102, S103, S201 and S202.

S101: in the data writing stage (namely DAT_IN' stage) of the sensing period (one of the sensing sub-periods of the sensing period), inputting a first scanning signal (valid signal) into a first scanning signal line G1, inputting a second scanning signal (valid signal) into a second scanning signal line G2, inputting an invalid signal into a third scanning signal line G3, inputting a first reference voltage (e.g., a reference voltage Vref) into a sensing signal line Sense_Line, inputting a sensing data signal (the sensing data signal is, for example, stored in the storage capacitor Cst) into one data signal line DAT (the data signal line connected with the pixel drive circuit that is detected in this sensing sub-period) among a plurality of data signal lines, and inputting a turn-off data signal (generally a 0V voltage signal) into all the remaining data signal lines among the plurality of data signal lines.

Illustratively, in the DAT_IN' stage of the sensing period as illustrated in FIGS. 2 and 3, the first scanning signal is inputted into the first scanning signal line G; the second scanning signal is inputted into the second scanning signal line G2; the switching transistor SW and the sensing transistor SE are switched on; in this case, the reference voltage Vref inputted into the sensing signal line Sense_Line is written into the first node S; the sensing data signal inputted into one (the data signal line connected with the pixel drive circuit to be detected) of four data signal lines connected with four pixel drive circuits is stored into the storage capacitor Cst; and the 0V voltage signal is inputted into all the remaining data signal lines. For example, because an invalid signal is inputted into the third scanning signal line G3, the first electrode of the driving transistor DR does not receive a first voltage, so the driving transistor DR does not generate a driving current, thereby improving the accuracy of the voltage (namely the voltage of the first node S) written into the signal output terminal of the pixel drive circuit through the sensing signal line Sense_Line and improving the accuracy of the pixel compensation data (for example, the threshold voltage of the driving transistor of the pixel drive circuit) of the pixel drive circuit acquired through the sensing signal line Sense_Line, such that the accuracy of the gate-source voltage Vgs of the driving transistor DR in the data writing stage DAT_IN of the display period can be improved.

S102: in the sensing stage of the sensing period (one of the sensing sub-periods of the sensing period), inputting the first scanning signal (valid signal) into the first scanning signal line G1, inputting an invalid signal into the second scanning signal line G2, inputting the third scanning signal (valid signal) into the third scanning signal line G3, and allowing the driving transistor DR to charge the sensing signal line Sense_Line through the first node S, so as to allow the pixel compensation data to be capable of being acquired through the sensing signal line Sense_Line in the sampling stage of the sensing period (one of the sensing sub-period of the sensing period).

Illustratively, in the Sens stage of the sensing period as illustrated in FIGS. 2 and 3, the first scanning signal is inputted into the first scanning signal line G1 and the third scanning signal is inputted into the third scanning signal line G3, so that the sensing transistor SE and the common transistor COM can be switched on. In this case, the sensing signal line Sense_Line can be charged through the first node S based on the data voltage stored in the storage capacitor Cst, such that sampling by utilization of a sensing IC connected with the sensing signal line Sense_Line can be performed after the charging process is completed, and then the pixel compensation data can be acquired.

S103: in the sampling stage Samp of the sensing period (one of the sensing sub-periods of the sensing period), inputting an invalid signal into the first scanning signal line G1, inputting an invalid signal into the second scanning signal line G2, and inputting the third scanning signal (valid signal) into the third scanning signal line G3.

For example, because the invalid signal is inputted into the second scanning signal line G2, the sensing transistor SE can be switched off in the sampling stage, so the pixel compensation data acquired through the sensing signal line Sense_Line can be more accurate.

For example, in the case where the pixel circuit unit comprises a plurality of pixel drive circuits and the sensing period includes a plurality of sensing sub-periods, the steps S101 to S103 may be respectively executed for the plurality of pixel drive circuits, so as to acquire the pixel compensation data (for example, the threshold voltages of the driving transistors of the plurality of pixel drive circuits) of the plurality of pixel drive circuits.

For example, a plurality of sensing processes may be repeated (namely the steps S101 to S103 may be executed for a plurality of times) to finish the process of sensing the plurality of pixel drive circuits of the pixel circuit unit, so as to complete the pixel data compensation of subpixels subsequently.

S201: in the data writing stage DAT_IN of the display period, inputting the first scanning signal (valid signal) into the first scanning signal line G1, inputting the second scanning signal (valid signal) into the second scanning signal line G2, inputting an invalid signal into the third scanning signal line G2, inputting a second reference voltage (e.g., a reference voltage Vref) into the sensing signal line Sense_Line, and respectively inputting corresponding compensating pixel data into different data signal lines DAT and storing the compensating pixel data. Here, the compensating pixel data (for example, compensating pixel data voltages) are pixel data obtained through compensating initial pixel data based on corresponding pixel compensation data. For example, the initial pixel data are pixel data before compensation.

Illustratively, in the DAT_IN stage of the display period as illustrated in FIGS. 2 and 3, the first scanning signal is inputted into the first scanning signal line G; the second scanning signal is inputted into the second scanning signal line G2; the switching transistor SW and the sensing transistor SE are switched on; in this case, the reference voltage Vref inputted into the sensing signal line Sense_Line is written into the first node S; and the compensating pixel data respectively inputted into four data signal lines connected with the four pixel drive circuits are respectively stored into corresponding storage capacitors Cst. Here, the compensating pixel data are pixel data obtained through compensating the initial pixel data according to the pixel compensation data acquired in the sensing period.

For example, because an invalid signal is inputted into the third scanning signal line G3 in the data writing stage DAT_IN of the display period, the first electrode of the driving transistor DR does not receive a first voltage, so the driving transistor DR does not generate a driving current, thereby improving the accuracy of the voltage (namely the voltage of the first node S) written into the signal output terminal of the pixel drive circuit through the sensing signal line Sense_Line, and further improving the accuracy of the gate-source voltage Vgs of the driving transistor DR.

S202: in the effective display stage (namely Disp stage) of the display period, inputting an invalid signal into the first scanning signal line G1, inputting an invalid signal into the second scanning signal line G2, and inputting the third scanning signal (valid signal) into the third scanning signal line G3, so as to drive the LEDs of the plurality of pixel drive circuits to emit light according to corresponding compensating pixel data.

Illustratively, in the Disp period of the display period as illustrated in FIGS. 2 and 3, the third scanning signal is inputted into the third scanning signal line G3, and the common transistor COM is switched on. In this case, the driving transistor DR is switched on under the action of the compensating pixel data stored in the storage capacitor Cst, so as to drive the LED to emit light.

The following two points should be noted.

Firstly, description is given to the turn-on and turn-off processes of the transistor in FIG. 2 by taking the case where all the transistors are N-type transistors as an example, but the embodiments of the present disclosure are not limited thereto. All the transistors in FIG. 2 may also be P-type transistors. Of course, in this case, control signals in FIG. 3 is required to be inverted.

Secondly, FIG. 3 only illustrates one display period and one sensing period. It should be understood that it's still the display period after the sensing period, and the compensating pixel data adopted in the display period are acquired in the sensing period before the display period. In addition, the sample period and the display period in FIG. 3 are independent periods in timing sequence, and FIG. 3 is only schematic illustration.

In addition, it should be also understood that, in the DAT IN stage of the display period and the DAT IN' stage of the sensing period, no scanning signal is provided to the third scanning signal line (namely the signal on the third scanning signal line is an invalid signal), and the common transistor COM is in a turn-off state. In this case, the voltages Vs at different first nodes S are irrelevant to the values of the pixel data inputted into the data signal lines DAT and does not change along with the change of the pixel data (e.g., the data voltage), namely the voltages Vs at the first nodes S are fixed voltages, so the accuracy of writing the display grayscale can be guaranteed.

The voltage of the first node S of the pixel circuit unit as illustrated in FIG. 1 can change along with the change of the pixel data inputted into the data signal line DAT. For example, when the pixel data inputted into the data signal line DAT is larger, the current generated by the driving transistor DR is larger (for example, the current flowing across the OLED is larger), so the voltage of the first node S is higher, and then the error of the voltage of the first node S is larger.

For example, when the pixel circuit unit is applied in a display panel, in the debugging of the driving signal before the display panel leaves the factory, each grayscale (e.g., 0-255 grayscales) of the pixel circuit unit as illustrated in FIG. 1 is required to be debugged; but the pixel circuit unit in some embodiments of the present disclosure (FIG. 2 or FIG. 6) only needs to be debugged with respect to one grayscale and then the accuracy of other grayscales can be ensured. For example, the grayscale selected for debugging may be 127 grayscale or 64 grayscale, but not limited thereto.

For example, the inventors of the present disclosure have further confirmed by actual simulation that the voltage Vs of the first node S is irrelevant to the value of the pixel data inputted into the data signal line DAT in the embodiments of the present disclosure, with the specific analysis as follows.

Figure 4:
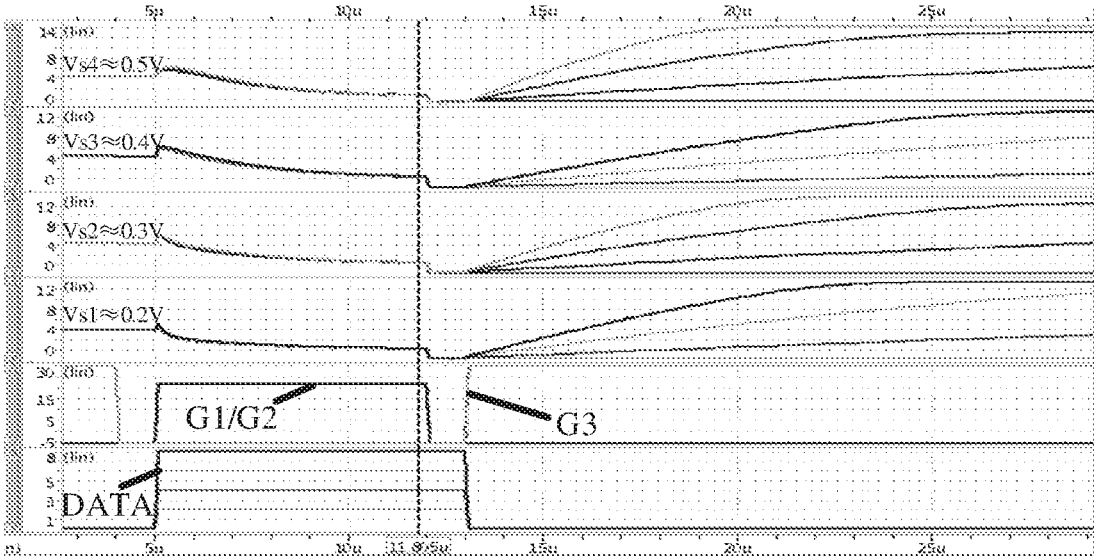
FIG. 4 is an analog diagram of a voltage signal at a first node of a pixel circuit unit provided by an embodiment of the present disclosure.

FIG. 4 is an analog diagram of a voltage signal at the first node S of the pixel circuit unit as illustrated in FIGS. 2 and 6. As illustrated in FIG. 4, because four sensing transistors SE in the pixel circuit unit adopt a series connection structure (source/drain electrodes are sequentially connected) and the sensing transistor has a certain resistance, the voltage Vs of the first nodes S connected with different sensing transistors SE in the pixel circuit unit can have a certain difference. For example, Vs1, Vs2, Vs3 and Vs4 in FIG. 4 are respectively fixed voltages, that is, 0.2V, 0.3V, 0.4V and 0.5V. For example, Vs1, Vs2, Vs3 and Vs4 respectively represent the voltage of the first nodes S of the pixel drive circuits disposed at the first position from right to left, the second position from right to left, the third position from right to left, and the four position from right to left, in FIGS. 2 and 6 (namely the voltage values corresponding to intersections of the vertical dotted line in FIG. 4 and the curves in the four sub-graphs in FIG. 4).

For example, as illustrated in FIG. 4, illustratively, pixel data, that is, 2V, 4V, 6V and 8V, are inputted into (each) data signal lines DAT in the pixel circuit unit. It can be seen that, in the inputting stage of the pixel data (namely corresponding to the DAT_IN stage in FIG. 3), under different pixel data, the curves corresponding to the voltages Vs of the first node S (that is, the anode voltage of an OLED) substantially coincide, that is, the voltage Vs of the first node S is not affected by the pixel data.

The embodiments of the present disclosure further provides a display panel, which comprises the foregoing pixel circuit unit. For example, the display panel comprises a plurality of subpixels arranged in a matrix. The plurality of pixel drive circuits in the pixel circuit unit are in one-to-one correspondence with the plurality of subpixels. For example, each of the plurality of subpixels includes one corresponding pixel drive circuit. For example, because detailed description regarding the structure and the advantages of the pixel circuit unit has been given in the above-mentioned embodiments, no further description will be given here.

It should be noted that in the embodiment of the present disclosure, the display panel may specifically at least include an OLED display panel. For example, the display panel may be applied in any product or component with display function such as a display, a TV, a digital photo frame, a mobile phone or a tablet PC.

For example, adjacent subpixels of different colors disposed in the same row of subpixels form one of pixel units; a plurality of subpixels in one of pixel units are in one-to-one correspondence with the plurality of pixel drive circuits in one pixel circuit unit. The number of the subpixels in the pixel unit is not limited in the embodiment of the present disclosure and may be actually selected as required.

For example, the pixel unit may include subpixels of three colors, namely a red subpixel R, a green subpixel G and a blue subpixel B. In this case, the pixel circuit unit includes three sequentially arranged pixel drive circuits which are in one-to-one correspondence with the red subpixel R, the green subpixel G and the blue subpixel B which are adjacent to each other.

For another example, the pixel unit further includes subpixels of four colors, namely a red subpixel R, a green subpixel G a blue subpixel B and a white subpixel W. In this case, the pixel circuit unit includes four sequentially arranged pixel drive circuits which are in one-to-one correspondence with the red subpixel R, the green subpixel Q the blue subpixel B and the white subpixel W which are adjacent to each other.

For another example, the pixel unit further includes subpixels of five colors, namely a red subpixel R, a green subpixel G, a blue subpixel B, a cyan subpixel C and a yellow subpixel Y. In this case, the pixel circuit unit includes five sequentially arranged pixel drive circuits which are in one-to-one correspondence with the red subpixel R, the green subpixel G, the blue subpixel B, the cyan subpixel C and the yellow subpixel Y which are adjacent to each other.

For example, in actual arrangement, the plurality of pixel circuit units corresponding to the plurality of pixel units disposed in the same row may respectively adopt the same first scanning signal line, the same second scanning signal line, and the same third scanning signal line; and the pixel circuit units corresponding to the pixel units in the same column may share one sensing signal line.

Embodiments of the present disclosure provides a display device, which comprises the foregoing pixel circuit unit or the foregoing display panel. Because detailed description regarding the structure and the advantages of the pixel circuit unit has been given in the above-mentioned embodiments, no further description will be given here.

Although detailed description has been given above to the present disclosure with general description and embodiments, it shall be apparent to those skilled in the art that some modifications or improvements may be made on the basis of the embodiments of the present disclosure. Therefore, all the modifications or improvements made without departing from the spirit of the present disclosure shall all fall within the scope of protection of the present disclosure.

What are described above is related to the illustrative embodiments of the disclosure only and not limitative to the scope of the disclosure; the scopes of the disclosure are defined by the accompanying claims.

What is claimed is:

1. A pixel circuit unit, comprising a plurality of pixel drive circuits and a voltage control circuit, wherein the plurality of pixel drive circuits are arranged side by side along an extension direction of a first scanning signal line;

the voltage control circuit comprises a first terminal and a second terminal; the first terminal of the voltage control circuit is connected with a first voltage terminal to receive a first supply voltage provided by the first voltage terminal;

each pixel drive circuit comprises a light-emitting drive circuit, and the light-emitting drive circuit comprises a supply voltage receiving terminal and a control terminal; the supply voltage receiving terminal of the light-emitting drive circuit of the each pixel drive circuit is electrically connected with the second terminal of the voltage control circuit, so as to allow the supply voltage receiving terminal of the light-emitting drive circuit of the each pixel drive circuit to be capable of receiving the first supply voltage;

the voltage control circuit is configured to be disconnected in a data voltage writing stage, so that the supply voltage receiving terminal of the light-emitting drive circuit of the each pixel drive circuit does not receive the first supply voltage in the data voltage writing stage;

the each pixel drive circuit further comprises a sensing transistor, and the sensing transistor comprises a first electrode, a second electrode and a gate electrode;

the gate electrode of the sensing transistor is connected with the first scanning signal line to receive a signal provided by the first scanning signal line;

the first electrode of the sensing transistor is connected with a signal output terminal of the light-emitting drive circuit;

except the last pixel drive circuit, the second electrode of the sensing transistor of the each pixel drive circuit is connected with first electrode of sensing transistor of the next pixel drive circuit; and second electrode of sensing transistor of the last pixel drive circuit is connected with a sensing signal line; and sensing transistors of the plurality of pixel drive circuits are configured to detect pixel compensation data of the plurality of pixel drive circuits respectively in a plurality of sensing sub-periods of a sensing period of the pixel circuit unit.

2. The pixel circuit unit according to claim 1, further comprising a common line, wherein the second terminal of the voltage control circuit and supply voltage receiving terminals of light-emitting drive circuits of the plurality of pixel drive circuits are all connected with the common line.

3. The pixel circuit unit according to claim 2, wherein an extension direction of the common line is same with an arrangement direction of the plurality of pixel drive circuits;

the common line comprises a first end and a second end;

the second terminal of the voltage control circuit is connected with the common line at a first position on the common line;

the first position is disposed between the first end of the common line and the second end of the common line, and the first position is a resistance midpoint between the first end and the second end of the common line; and supply voltage receiving terminals of light-emitting drive circuits of two pixel drive circuits, arranged on the outmost, among the plurality of pixel drive circuits are respectively connected with the first end of the common line and the second end of the common line.

4. The pixel circuit unit according to claim 1, wherein the voltage control circuit comprises a common transistor, and the common transistor comprises a first electrode, a second electrode and a gate electrode;

the first electrode of the common transistor, which serves as the first terminal of the voltage control circuit, is connected with the first voltage terminal;

the second electrode of the common transistor, which serves as the second terminal of the voltage control circuit, is electrically connected with supply voltage receiving terminals of light-emitting drive circuits of the plurality of pixel drive circuits; and the gate electrode of the common transistor is connected with a third scanning signal line to receive a signal provided by the third scanning signal line.

5. The pixel circuit unit according to claim 1, wherein the light-emitting drive circuit comprises a driving transistor, and the driving transistor comprises a first electrode, a second electrode and a gate electrode;

the first electrode of the driving transistor, which serves as the supply voltage receiving terminal of the light-emitting drive circuit, is connected with the voltage control circuit;

the second electrode of the driving transistor, which serves as a signal output terminal of the light-emitting drive circuit, is connected with a first node; and the gate electrode of the driving transistor, which serves as the control terminal of the light-emitting drive circuit, is configured to receive a data voltage.

6. The pixel circuit unit according to claim 5, wherein the light-emitting drive circuit further comprises a switching transistor and a storage capacitor;

the switching transistor comprises a gate electrode, a first electrode and a second electrode;

the storage capacitor comprises a first terminal and a second terminal;

the gate electrode of the switching transistor is connected with a second scanning signal line to receive a signal provided by the second scanning signal line;

the first electrode of the switching transistor is connected with a data signal line to receive the data voltage;

the second electrode of the switching transistor is connected with a second node and connected with the gate electrode of the driving transistor; and the first terminal of the storage capacitor is connected with the first node, and the second terminal of the storage capacitor is connected with the second electrode of the switching transistor and the second node.

7. The pixel circuit unit according to claim 6, wherein first electrodes of switching transistors of light-emitting drive circuits of different pixel drive circuits are connected with different data signal lines.

8. The pixel circuit unit according to claim 1 wherein sensing transistors are bottom-gate type transistors.

9. The pixel circuit unit according to claim 1, wherein the pixel circuit unit comprises three, four or five pixel drive circuits.

10. A pixel circuit unit, comprising a plurality of pixel drive circuits that are sequentially connected and a voltage control circuit connected with the pixel drive circuits, wherein each pixel drive circuit comprises: a light-emitting drive circuit, a sensing transistor and an LED;

the light-emitting drive circuit comprises a storage capacitor, and the storage capacitor is connected with a first node;

a first electrode of the sensing transistor, the light-emitting drive circuit, and an anode of the LED are connected with each other through the first node;

except the last pixel drive circuit, a second electrode of the sensing transistor in the each pixel drive circuit is connected with a first node in the next pixel drive circuit; second electrode of sensing transistor in the last pixel drive circuit is connected with a sensing signal line; gate electrodes of all sensing transistors in the pixel circuit unit are connected with a first scanning signal line;

all light-emitting drive circuits in the pixel circuit unit are connected with a second scanning signal line; all the light-emitting drive circuits are connected with a first voltage terminal through the voltage control circuit; the voltage control circuit is connected with a third scanning signal line, so as to control, through the third scanning signal line, whether or not the light-emitting drive circuits are connected with the first voltage terminal;

different light-emitting drive circuits are connected with different data signal lines;

the pixel circuit unit further comprises a common line;

the voltage control circuit comprises a first terminal and a second terminal;

the first terminal of the voltage control circuit is connected with the first voltage terminal to receive a first supply voltage provided by the first voltage terminal;

the second terminal of the voltage control circuit and supply voltage receiving terminals of light-emitting drive circuits of the plurality of pixel drive circuits are all connected with the common line;

an extension direction of the common line is same with an arrangement direction of the plurality of pixel drive circuits;

the common line comprises a first end and a second end;

the second terminal of the voltage control circuit is connected with the common line at a first position on the common line;

the first position is disposed between the first end of the common line and the second end of the common line, and the first position is a resistance midpoint between the first end and the second end of the common line; and supply voltage receiving terminals of light-emitting drive circuits of two pixel drive circuits, arranged on the outmost, among the plurality of pixel drive circuits are respectively connected with the first end of the common line and the second end of the common line.

11. A driving method of the pixel circuit unit according to claim 1, comprising:

providing an invalid signal to a control terminal of the voltage control circuit in a data voltage writing stage, so as to allow the voltage control circuit to be disconnected in the data voltage writing stage, and allow supply voltage receiving terminals of a plurality of light-emitting drive circuits to not receive the first supply voltage in the data voltage writing stage.

12. The driving method according to claim 11, wherein the voltage control circuit comprises a common transistor, and the common transistor comprises a gate electrode, a first electrode and a second electrode;

the first electrode of the common transistor, which serves as the first terminal of the voltage control circuit, is connected with the first voltage terminal; the second electrode of the common transistor, which serves as the second terminal of the voltage control circuit, is electrically connected with the supply voltage receiving terminals of the plurality of light-emitting drive circuits; and providing the invalid signal to the control terminal of the voltage control circuit in the data voltage writing stage comprises:

providing the invalid signal to the gate electrode of the common transistor in the data voltage writing stage, so as to disconnect the first terminal of the voltage control circuit and the second terminal of the voltage control circuit.

13. The driving method according to claim 11, wherein the driving method further comprises:

in a data voltage writing stage of each sensing sub-period, providing a sensing data voltage to a control terminal of a light-emitting drive circuit of a pixel drive circuit to be detected among the plurality of pixel drive circuits, and providing a turn-off data voltage to control terminals of light-emitting drive circuits of other pixel drive circuits among the plurality of pixel drive circuits, so as to acquire pixel compensation data of the pixel drive circuit to be detected.

14. The driving method according to claim 11, further comprising: in a display period of the pixel circuit unit, respectively providing corresponding compensating pixel data to control terminals of light-emitting drive circuits of the plurality of pixel drive circuits, wherein the corresponding compensating pixel data are: pixel data obtained through compensating initial pixel data based on corresponding pixel compensation data.

15. A driving method of the pixel circuit unit according to claim 10, comprising:

in a data voltage writing stage of a sensing period, inputting a first scanning signal into the first scanning signal line, inputting a second scanning signal into the second scanning signal line, inputting an invalid signal into the third scanning signal line, inputting a first reference voltage into the sensing signal line, inputting a sensing data signal into one data signal line among a plurality of data signal lines and storing the sensing data signal, and inputting a turn-off data signal into the remaining data signal lines among the plurality of data signal lines;

in a sensing stage of the sensing period, inputting the first scanning signal into the first scanning signal line, inputting an invalid signal into the second scanning signal line, and inputting a third scanning signal into the third scanning signal line, so as to charge the sensing signal line through the first node;

in a sampling stage of the sensing period, acquiring pixel compensation data through the sensing signal line;

in a data voltage writing stage of a display period, inputting the first scanning signal into the first scanning signal line, inputting the second scanning signal into the second scanning signal line, inputting an invalid signal into the third scanning signal line, inputting a second reference voltage into the sensing signal line, respectively inputting corresponding compensating pixel data into the different data signal lines, and storing the corresponding compensating pixel data, wherein the corresponding compensating pixel data are: pixel data obtained through compensating initial pixel data according to corresponding pixel compensation data; and in an effective display stage of the display period, inputting an invalid signal into the first scanning signal line, inputting an invalid signal into the second scanning signal line, and inputting the third scanning signal into the third scanning signal line, so as to control LEDs driven by the pixel circuit unit to emit light according to the corresponding compensating pixel data.

16. A display panel, comprising the pixel circuit unit according to claim 1.

17. The display panel according to claim 16, wherein the display panel comprises a plurality of subpixels arranged in a matrix; the plurality of pixel drive circuits in the pixel circuit unit are in one-to-one correspondence with the plurality of subpixels;

adjacent subpixels of different colors disposed in a same row of subpixels form one of pixel units;

a plurality of subpixels in one of the pixel units are in one-to-one correspondence with a plurality of pixel drive circuits in one of pixel circuit units; and each pixel unit comprises a red subpixel, a green subpixel and a blue subpixel; or each pixel unit comprises a red subpixel, a green subpixel, a blue subpixel and a white subpixel; or each pixel unit comprises a red subpixel, a green subpixel, a blue subpixel, a cyan subpixel and a yellow subpixel.

18. A display device, comprising the pixel circuit unit according to claim 1.

19. A driving method of a pixel circuit unit, comprising:

in a data voltage writing stage of each sensing sub-period, providing a sensing data voltage to a control terminal of a light-emitting drive circuit of a pixel drive circuit to be detected among a plurality of pixel drive circuits of the pixel circuit unit, and providing a turn-off data voltage to control terminals of light-emitting drive circuits of other pixel drive circuits among the plurality of pixel drive circuits, so as to acquire pixel compensation data of the pixel drive circuit to be detected;

providing an invalid signal to a control terminal of a voltage control circuit of the pixel circuit unit in the data voltage writing stage, so as to allow the voltage control circuit to be disconnected in the data voltage writing stage, and allow supply voltage receiving terminals of a plurality of light-emitting drive circuits of the pixel drive circuit to not receive a first supply voltage provided by a first voltage terminal in the data voltage writing stage, wherein the plurality of pixel drive circuits are arranged side by side along an extension direction of a first scanning signal line;

the voltage control circuit comprises a first terminal and a second terminal; the first terminal of the voltage control circuit is connected with the first voltage terminal to receive the first supply voltage provided by the first voltage terminal;

each pixel drive circuit comprises a light-emitting drive circuit, and the light-emitting drive circuit comprises a supply voltage receiving terminal and a control terminal; the supply voltage receiving terminal of the light-emitting drive circuit of the each pixel drive circuit is electrically connected with the second terminal of the voltage control circuit, so as to allow the supply voltage receiving terminal of the light-emitting drive circuit of the each pixel drive circuit to be capable of receiving the first supply voltage;

the each pixel drive circuit further comprises a sensing transistor, and the sensing transistor comprises a first electrode, a second electrode and a gate electrode;

the gate electrode of the sensing transistor is connected with the first scanning signal line to receive a signal provided by the first scanning signal line;

the first electrode of the sensing transistor is connected with a signal output terminal of the light-emitting drive circuit;

except the last pixel drive circuit, the second electrode of the sensing transistor of the each pixel drive circuit is connected with first electrode of sensing transistor of the next pixel drive circuit; and second electrode of sensing transistor of the last pixel drive circuit is connected with a sensing signal line; and sensing transistors of the plurality of pixel drive circuits are configured to detect pixel compensation data of the plurality of pixel drive circuits respectively in a plurality of sensing sub-periods of a sensing period of the pixel circuit unit.

* * * * *